US010638802B2

(12) United States Patent
Shibata

(10) Patent No.: US 10,638,802 B2
(45) Date of Patent: May 5, 2020

(54) MASK PROVIDED WITH LATCH

(71) Applicant: KOKEN LTD., Chiyoda-ku, Tokyo (JP)

(72) Inventor: Shinnosuke Shibata, Tokyo (JP)

(73) Assignee: KOKEN LTD., Tokyo (JP)

( * ) Notice: Subject to any disclaimer, the term of this patent is extended or adjusted under 35 U.S.C. 154(b) by 0 days.

(21) Appl. No.: 16/095,343

(22) PCT Filed: Apr. 13, 2017

(86) PCT No.: PCT/JP2017/015059
§ 371 (c)(1),
(2) Date: Oct. 19, 2018

(87) PCT Pub. No.: WO2017/183545
PCT Pub. Date: Oct. 26, 2017

(65) Prior Publication Data

US 2019/0133219 A1 May 9, 2019

(30) Foreign Application Priority Data

Apr. 21, 2016 (JP) ..... 2016-085601

(51) Int. Cl.
*A41D 13/11* (2006.01)
*A62B 18/02* (2006.01)

(52) U.S. Cl.
CPC ..... *A41D 13/1161* (2013.01); *A41D 13/11* (2013.01); *A41D 13/1138* (2013.01); *A62B 18/02* (2013.01)

(58) Field of Classification Search
CPC ..... A41D 13/1161; A41D 13/11; A41D 13/1176; A41D 13/1169; A41D 31/305;
(Continued)

(56) References Cited

U.S. PATENT DOCUMENTS 696,196 A * 3/1902 Rubin ..... A41D 13/1161 24/589.1
2014/0190492 A1* 7/2014 Noh ..... A41D 13/1161 128/863

FOREIGN PATENT DOCUMENTS

JP 2003-320041 A 11/2003
JP 2005-152229 A 6/2005
(Continued)

OTHER PUBLICATIONS

International Search Report in PCT Application No. PCT/JP2017/015059, dated Jul. 4, 2017, 4pp.

*Primary Examiner* — Ophelia A Hawthorne
(74) *Attorney, Agent, or Firm* — Hauptman Ham, LLP

(57) ABSTRACT

There is provided a mask provided with a latch that can maintain a latched state of fastening cords and suppress offsetting when the mask is worn.
A latch of a mask is in the form of an oblong thin sheet, and includes a first latching part for disengageably latching one fastening cord of the mask and a second latching part positioned on the second end edge side of the first latching part, having an insertion through hole for inserting the other fastening cord of the mask in advance. The first latching part has a guide channel extending from the first lateral edge and a first latching hole connected to the guide channel, and the second latching part has a second latching hole communicating with the insertion through hole, and having an outer shape smaller than that, and the first latching hole and the second latching hole are directed in directions opposed to one another in a lateral direction.

7 Claims, 7 Drawing Sheets

(58) Field of Classification Search
CPC .... A41D 2400/52; A41D 13/00; A41D 13/05; A41D 20/00; A41D 2300/32; A41D 2400/44; A41D 27/12; A41D 13/1146; A41D 13/1184; H01L 23/4093
See application file for complete search history.

(56) References Cited

FOREIGN PATENT DOCUMENTS

| | | | |
|---|---|---|---|
| JP | 2008-49194 | A | 3/2008 |
| JP | 2012-90682 | A | 5/2012 |
| JP | 2013-252339 | A | 12/2013 |
| JP | 2015-93036 | A | 5/2015 |

* cited by examiner

MASK PROVIDED WITH LATCH

RELATED APPLICATIONS

The present application is a national phase of International Application Number PCT/JP2017/015059, filed Apr. 13, 2017, which claims priority to Japanese Application Number 2016-085601, filed Apr. 21, 2016.

TECHNICAL FIELD

The present disclosure relates to a mask provided with latch.

BACKGROUND

Conventionally, masks provided with a latch for latching fastening cords are well known. For example, Patent Literature 1 discloses a mask provided with latch having an oblong rectangular shape, which has a pair of hook parts positioned vertically at both end portions facing in a longitudinal direction. The upper and lower hook parts of the latch have a latching hole in which an upper portion and a lower portion of the fastening cord are latched, and a guide channel for guiding the upper portion and the lower portion into the guide channel.

CITATION LIST

Patent Literature

Patent Literature 1: Japanese Patent Application Laid-open Publication No. 2015-93036

According to the mask provided with latch disclosed in Patent Literature 1, by the latch being disposed on a rear-surface side of the head of a wearer, and by latching the upper and lower portions of the fastening cord in the latching hole upon guiding from the guide channel of the upper and lower hook part, since a mutually branched state of the upper and lower portions of the fastening cord being maintained, it is possible to fit a face-contact part of a mask body to the face of the wearer.

However, the fastening cord in the form of a rubber string being only latched in the upper and lower hook parts, in the worn state of the mask, when the wearer moves mouth, the fastening cord may slide downward in the upper and lower hook parts, and the fastening cord may shift in position. On the other hand, when a pulling force of the upper portion of the fastening cord is made relatively large for preventing the shift in position, an upper side of the ear of the wearer making contact with the upper portion may be rubbed and the upper portion may create a feeling of discomfort and pain against the wearer. Moreover, the guide channel being of a size that enables an entry and exit of the fastening cord, in a state of the fastening cord latched in the latching hole of the upper and lower hook parts, when the fastening cord is pulled to adjust a length thereof, the fastening cord may slip out through the guide channel.

SUMMARY OF THE INVENTION

Technical Problem

An object of the present invention is to improve the conventional invention, and to provide a mask provided with latch that can maintain a latched state of a fastening cord and suppress shifting in position when the mask is worn.

Solution to Problem

The present invention is directed to a mask provided with latch in the form of an oblong thin sheet, having a vertical direction and a lateral direction, and including a first and second lateral edges extending in the lateral direction and a first and second end edges extending in the vertical direction.

In the mask provided with latch according to the present invention, the latch may include a first latching part for disengageably latching one fastening cord of the mask, and a second latching part positioned on the second end edge side of the first latching part, and having an insertion through hole for inserting the other fastening cord of the mask in advance, wherein the first latching part has a guide channel extending from the first lateral edge, and a first latching hole connected to the guide channel, and the second latching part has a second latching hole communicating with the insertion through hole, and having an outer shape smaller than that, and the first latching hole and the second latching hole are directed in directions opposed to one another in the lateral direction.

Advantageous Effects of Invention

In the mask provided with latch according to at least one embodiment of the present invention, in the latch, the first latching part having the guide channel extending from the first lateral edge and the first latching hole connected to the guide channel, and the second latching part has the second latching hole communicating with the insertion through hole, and having an outer shape smaller than that, and the first latching hole and the second latching hole are directed in directions opposed to one another in the lateral direction, in the worn state of the mask, it is possible to keep the mask body in close contact with the face by the fastening cord exerting the required tightening strength, and to suppress vertical shifting in position thereof without the fastening cord being disengaged from the latch.

BRIEF DESCRIPTION OF DRAWINGS

The drawings illustrate specific embodiments of the present invention including optional and preferred embodiments as well as essential features of the invention.

DESCRIPTION OF EMBODIMENTS

The embodiments described below relate to a mask 1 provided with a latch 10 as illustrated in FIG. 1 through FIG. 7, including both optional and preferred features as well as those features which are essential of the invention.

First Embodiment

Figure 1:
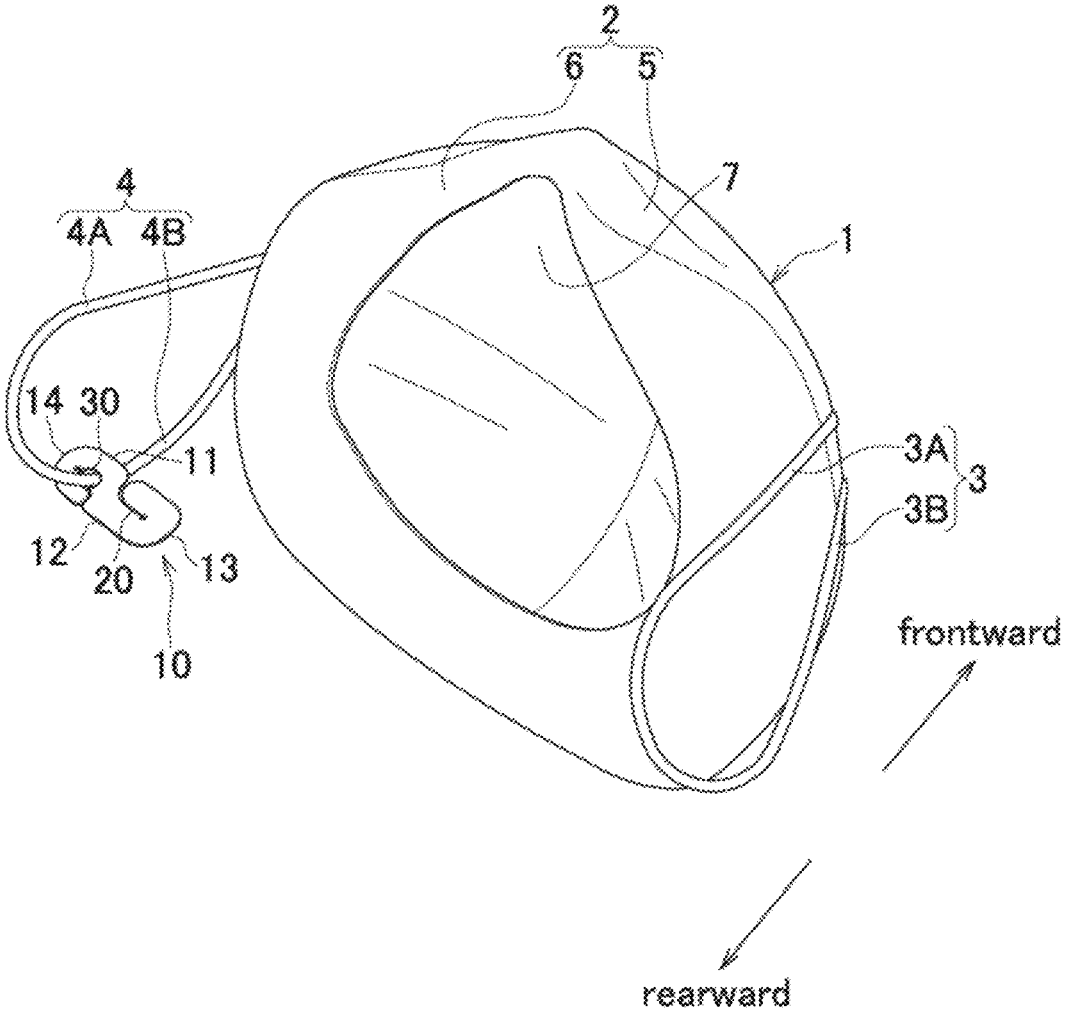
FIG. 1 is a rear-surface perspective view in a state of a latch latched to one fastening member, in a mask provided with latch in a first embodiment of the present invention.
Figure 2:
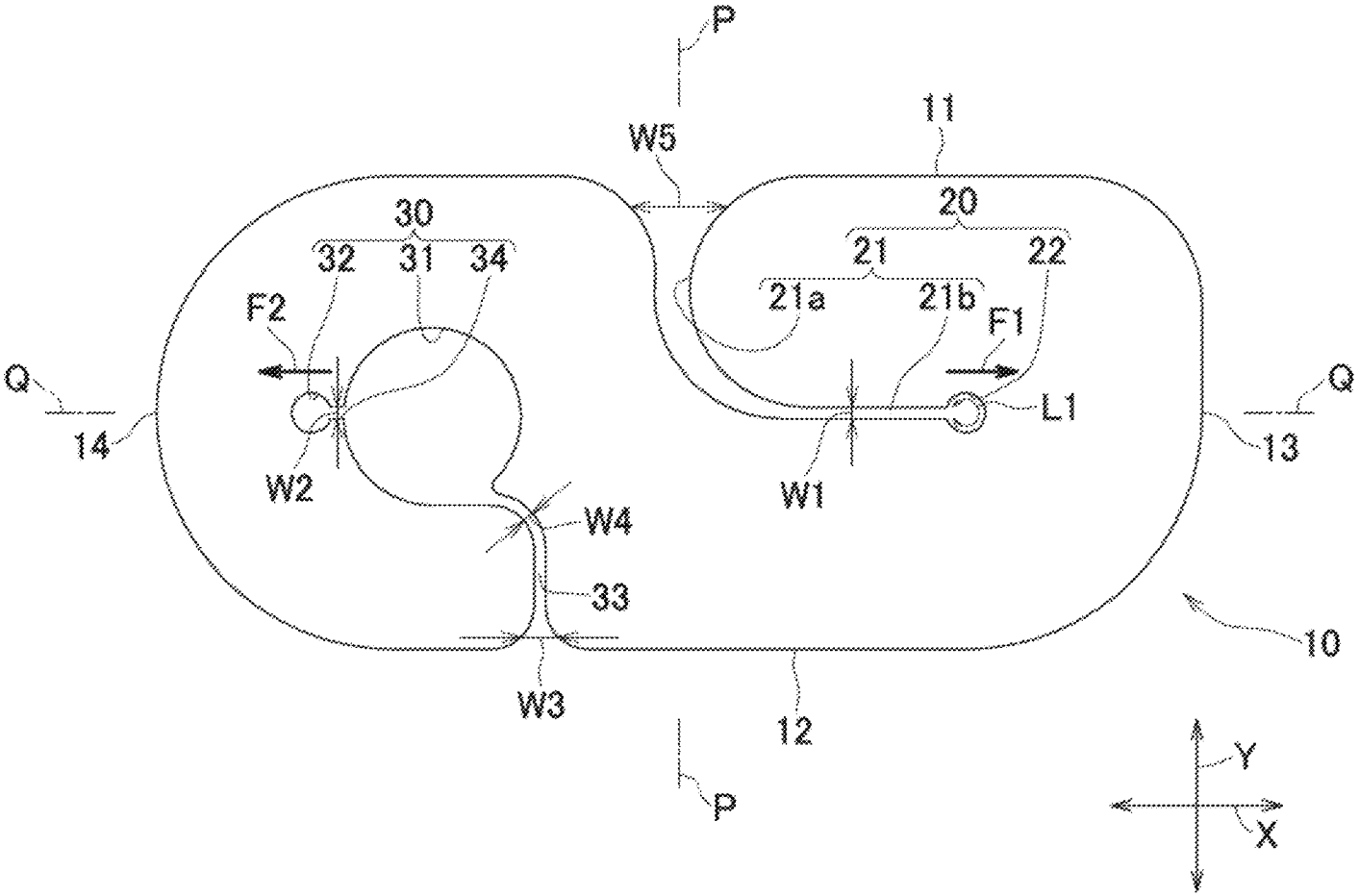
FIG. 2 is a plan view of the latch.
Figure 3:
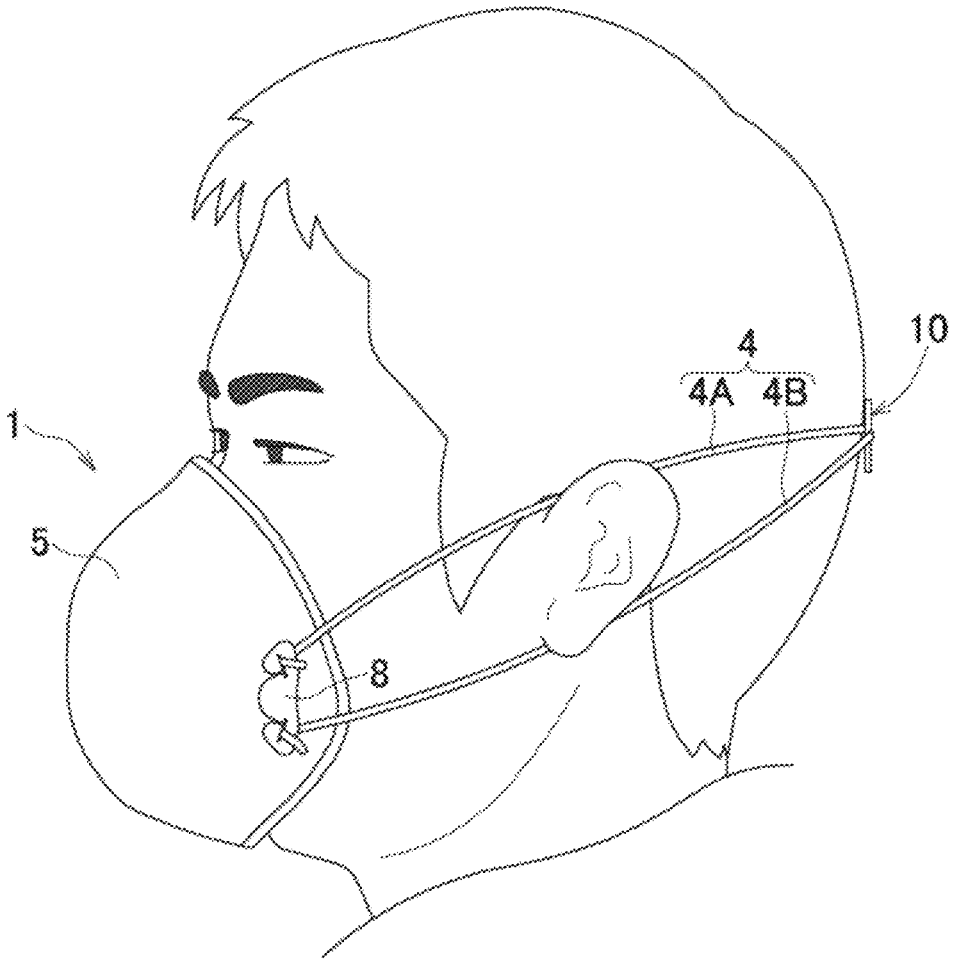
FIG. 3 is a side view of the mask in a worn state in which the pair of fastening cords are attached by the latch.
Figure 4:
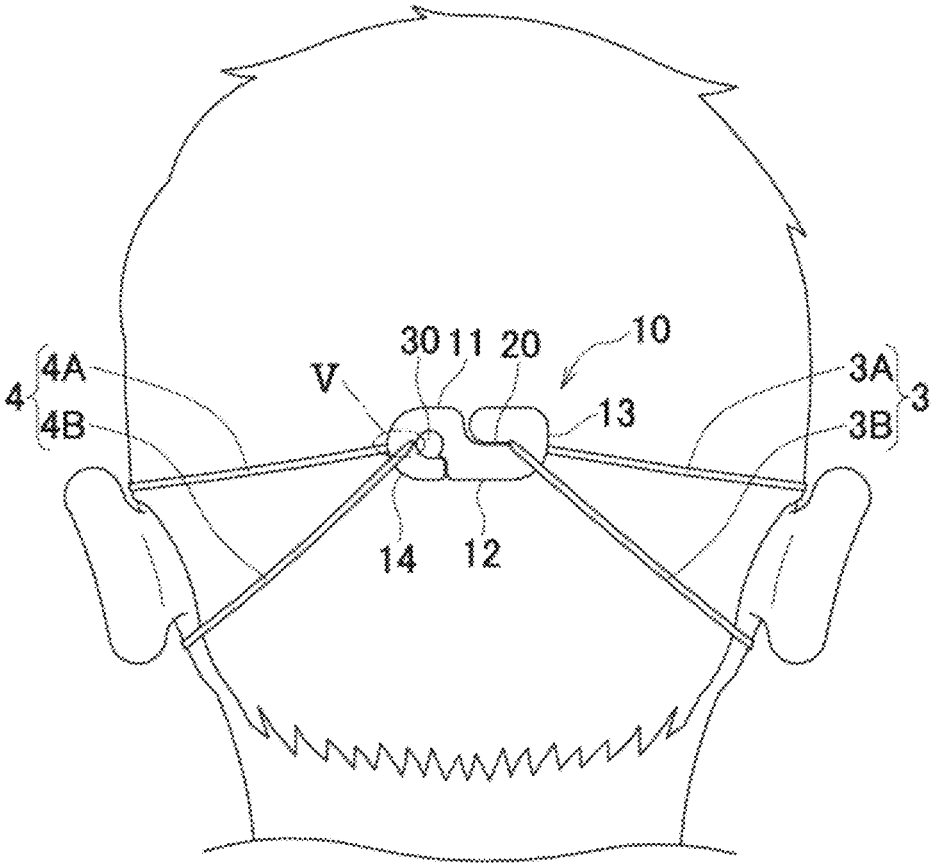
FIG. 4 is a rear view of the mask in the worn state in which the pair of fastening cords is attached by the latch.
Figure 5:
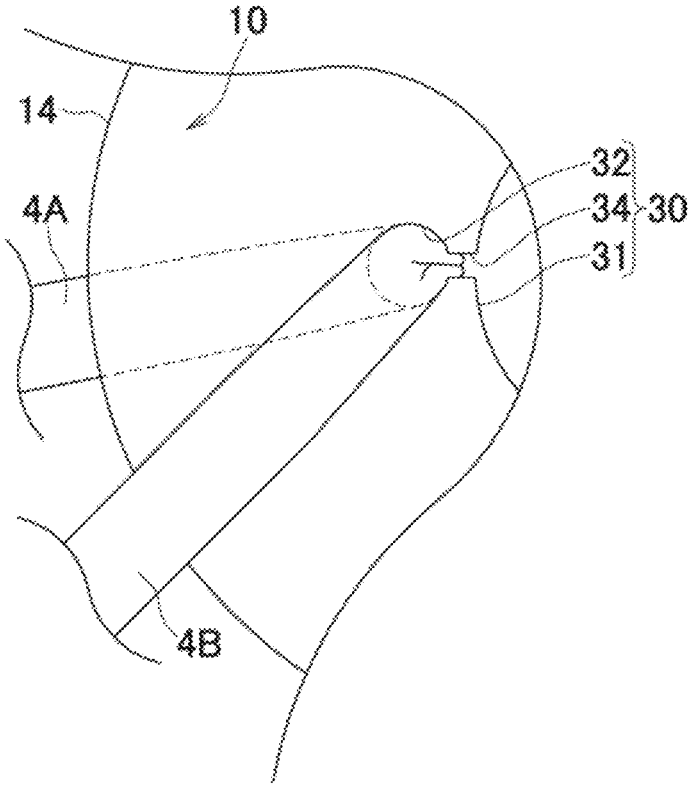
FIG. 5 is a partially enlarged view of a region surrounded by a V-line in FIG. 4.

Referring to FIGS. 1 to 3, a mask 1 has a mask body 2 and fastening cords 3, 4 having an annular shape extending from two lateral edges of the mask body 2, and a latch 10 is used for attaching the pair of fastening cords 3, 4 to one another at the rear of the head of a wearer. The mask body 2 has a covering part 5 formed to be cup-shaped to define an internal space 7, and a face-contact part 6 joined to a rear-surface side of an outer peripheral edge part of the covering part 5. The fastening cords 3, 4 have vertically branched upper portions 3A, 4A and lower portions 3B, 4B of which, two end parts are fixed to two lateral edge parts of the mask body 2 via a buckle 8.

For the fastening cords 3, 4, it is possible to use a cord elastic member made of strand-like rubber string and a belt elastic member having a required thickness dimension such as a flat rubber. In the worn state of the mask 1, for exerting a required fittability and sealability, the mask body 2 may be formed only of the covering part 5, or, the covering part 5, instead of molding to be cup-shaped, may be formed flatly by a plurality of fabrics or non-woven fabrics having a filter function, or may be formed three-dimensionally by folding over the plurality of fabrics or non-woven fabrics in the form of pleats.

Referring to FIG. 2, the latch 10 is in the form of an oblong thin sheet having a vertical direction Y and a lateral direction X, and a lateral center line Q bisecting a dimension in the vertical direction Y and a vertical center line P bisecting a dimension in the lateral direction X, and may include a first and second lateral edges 11, 12 extending in the lateral direction X, and a first and second end edges 13, 14 extending in the vertical direction Y. The first and second lateral edges 11, 12 are extended in a straight line in the lateral direction X, and the first and second end edges 13, 14 have a shape that is convex toward an outer side of the lateral direction X, and a corner portion at which both lateral edges 11, 12 and both end edges 13, 14 intersect one another has a curved shape. Moreover, a curvature of the second end edge 14 is larger than a curvature of the first end edge 13, and is a shape largely curved to be a circular-arc shape. However, to exhibit an effect of the present invention that will be described later, the curvature of the first and the second end edges 13, 14 may be the same or, the curvature of the first end edge 13 may be made larger than the curvature of the second end edge 14, and the curvatures thereof are not restricted to an illustrative example shown in the diagrams.

The latch 10 further has a first latching part 20 for latching one fastening cord 3 of the mask 1, and a second latching part 30 positioned on the second end edge 14 side of the first latching part 20, having an insertion through hole 31 for inserting the other fastening cord 4 of the mask 1. The first latching part 20 has a guide channel 21 extending inward from the first lateral edge 11, and a first latching hole 22 connected to the guide channel 21.

The guide channel 21 of the first latching part 20 has a curved part 21*a* extending to be curved from the first lateral edge 11 toward the first end edge 13 and a straight part 21*b* extending straight in the lateral direction X along the lateral center line Q to communicate from a trailing end of the curved part 21*a*. A width of the curved part 21*a* of the guide channel 21 narrows gradually as directed inward, and the width is the narrowest near a boundary with the straight part 21*b*. A width dimension W1 of the straight part 21*b* is same as a width dimension of the trailing end of the curved part 21*a*, and is almost constant. It is possible to change appropriately a degree of curve of the curved part 21*a* and the width dimension of the guide channel 21 according to a size of the latch 10 or a width dimension of the fastening cords 3, 4. In the present embodiment, a width dimension W5 of the widest portion of the guide channel 21, or in other words, a separating portion separating the first lateral edge 11 (a width dimension of the curved portion 21*a* on the first lateral edge 11 side), is at least three times the width dimension W1 of the straight part 21*b*.

The second latching part 30 further has a cut 33 extending inward from the second lateral edge 12 and communicating with the insertion through hole 31. A width of the cut 33 narrows as directed inward from the second lateral edge 12 side, and is slightly curved toward the second end edge 14 side at the insertion through hole 31 side. The insertion through hole 31 communicates with the second latching hole 32 via a neck part 34 on the second end edge 14 side. The second latching hole 32 has a circular shape with a diameter thereof smaller than the insertion through hole 31, and has nearly the same as that of the first latching hole 22. The first and second latching holes 22, 32 may have various known shapes such as an elliptical shape, a triangular shape, a polygonal shape and the like, in so far as the fastening cords are latched in a state of being elastically deformed. Moreover, the insertion through hole 31 also may have various known shapes such as an elliptical shape, a triangular shape, a polygonal shape and the like, in so long as the fastening cord 4 has a size that is insertable in advance.

Moreover, a width dimension W2 of the neck part 34 is smaller than a diameter of the second latching hole 32, and is nearly the same as the width dimension W1 of the straight part 21*b* of the guide channel 21 of the latching part 20. The width dimension W1 of the straight part 21*b* and the width dimension W2 of the neck part 34 are smaller than a width dimension of the fastening cords 3, 4 made of a belt elastic member or a diameter of the fastening cords 3, 4 made of a cord elastic member, and are sizes such that the fastening cords 3, 4 can pass toward the first and second latching holes 22, 32 while being deformed elastically.

The first latching hole 22 of the first latching part 20 is a small circular shaped hole communicating with the straight part 21*b*, and a diameter thereof is larger than the width dimension W1 of the straight part 21*b*. Moreover, the diameter of the second latching hole 32 is nearly the same as that of the first latching hole 22, and the first latching hole 22 and the second latching hole 32 are directed in directions opposed to one another in the lateral direction, along the lateral center line Q. Here, 'the first latching hole 22 and the second latching hole 32 are directed in directions opposed to one another in lateral direction X' means that in the first and second latching parts 20, 30, directional vectors F1, F2 directed from portions having a width narrower than the first and second latching holes (the straight part 21*b* in the first latching part 20 and the neck part 34 in the second latching part 30) toward the first and second latching holes 22, 32, are opposed to one another in the lateral direction X. Therefore, even in a case in which the first latching hole 22 and the second latching hole 32 are not on the lateral center line Q, and are offset toward the first and second lateral edges 11, 12, and when a shape of the guide channel 21 and/or the neck part 34 differ(s) from an illustrative example in the diagram, the first latching hole 22 and the second latching hole 32 can be said to oppose one another in the lateral direction X, in so far as the directional vectors F1 and F2 related to the first latching hole 22 and the second latching hole 32 are opposite. Therefore, the guide channel 21 of the first latching part 20 for example, may not have the curved part 21*a* and may be a straight line extending from the first lateral edge 11 upon being inclined with respect to the vertical center line P up to the first latching hole 22, and the cut 33 of the second latching part 30 may be a straight line extending to be directed in the vertical center line P from the second lateral edge 12 up to the insertion through hole 31.

One fastening cord 4 has been inserted in advance in advance into the insertion through hole 31 of the second latching part 30 at the time of manufacturing the mask 1. In such manner, by the fastening cord 4 being inserted in advance into the insertion through hole 31, during the process of manufacturing and when the mask 1 is taken out from an individually packaged bag, the latch 10 is not separated from the mask 1, and the latch 10 may not be lost before using it upon opening the packaged bag. To describe a wearing operation of the mask 1 by referring to FIG. 4 and FIG. 5, first, the wearer puts the face-contact part 6 of the mask body 2 on the face, and while maintaining the state of the face-contact portion 6 put on the face, holds by one hand the latch 10 through which the fastening cord 4 has been inserted and pulls toward the rear side of the head, and holds the fastening cord 3 by the other hand and pulls toward the rear side of the head. Next, the wearer pulls the fastening cord 3 with the guide channel 21 of the first latching part 20 as a guide, to lead to the first latching hole 22, and latches in the first latching hole 22 and moves the fastening cord 4 passed through the insertion through hole 31 to slide inside the neck part toward the second end edge 14, and latches in the second latching hole 32. By the guide channel 21 being formed in the first latching part 20, it is possible to move the fastening cord 3 easily to the first latching hole 22, and moreover, by the neck part 34 having a narrow width being positioned between the insertion through hole 31 and the second latching hole 32 in the second latching part 30, since it is possible to move the fastening cord 4 easily only by sliding the fastening cord 4 along the neck part 34, the wearer can carry out series of operations even without looking directly. The fastening cords 3 and 4, by being folded over upon being latched in the first and second latching holes 22, 32, are branched into the upper portions 3A, 4A and lower portions 3B, 4B. In such manner, by letting the annular-shaped fastening cords 3 and 4 to be branched vertically, and pulling up the upper portions 3A, 4A to be hooked on an upper side of an ear, it is possible to put the fastening cords 3, 4 stably around the ear.

For instance, in a case in which, the directional vectors F1, F2 of the first latching hole 22 and/or the second latching hole 32 are directed in the vertical direction Y, a force that keeps the mask body 2 in close contact with the face by the pulling force of the fastening cords 3, 4 may not be exerted adequately, and the mask body 2 when worn, may slip down from the face. In the present embodiment, the first latching hole 22 and the second latching hole 32 being directed in directions opposed to one another in the lateral direction X, the fastening cords 3, 4 are pulled in the lateral direction X via the latch 10, thereby enabling to exert the required tightening strength.

Figure 6A:
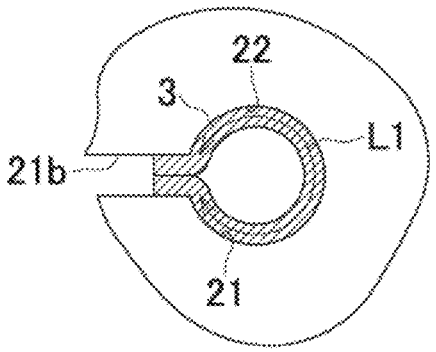
FIG. 6(A) is a diagram in a state in which a fastening cord using a belt elastic member is latched in the first latching hole.
Figure 6B:
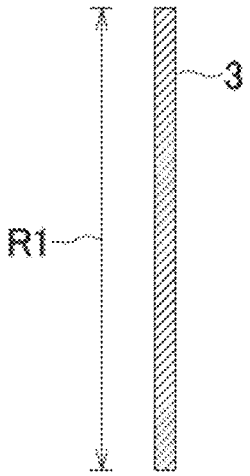
FIG. 6(B) is a cross-sectional view of the fastening cord using the belt elastic member.
Figure 6C:
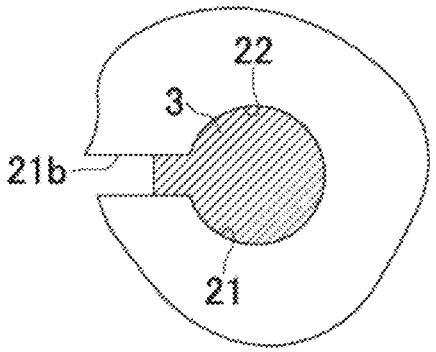
FIG. 6(C) is a diagram in a state in which a fastening cord using a cord elastic member is latched in the first latching hole.
Figure 6D:
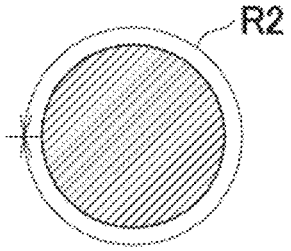
FIG. 6(D) is a cross sectional view of the fastening cord using the cord elastic member.

FIG. 6(A) is a diagram in a state in which the fastening cord 3 using a belt elastic member is latched in the first latching hole 22, FIG. 6(B) is a cross-sectional view of the fastening cord 3 using the belt elastic member, FIG. 6(C) is a diagram in a state in which the fastening cord 3 using a cord elastic member is latched in the second latching hole 22, and FIG. 6(D) is a cross-sectional view of the fastening cord 3 using the cord elastic member. FIGS. 6(A) to (D) show the states in which the fastening cord 3 is latched in the first latching hole 22. However, in the present embodiment, the first latching hole 22 and the second latching hole 32 having the same shape and same size, the latching of the fastening cord 4 is similar even in the second latching hole 32.

Referring to FIGS. 6(A), (B), in a case in which a belt elastic member such as a flat rubber having a predetermined width dimension R is used as the fastening cord 3 (the same for the fastening cord 4 as well), an inner peripheral length L1 of the first latching hole 22 is smaller than a width dimension R1 of the fastening cord 3. At the time of wearing the mask 1, for latching the fastening cord 3 in the first latching part 20, the fastening cord 3 is to be moved from the first lateral edge 11 side toward the first latching hole 22 with the guide channel 21 as a guide. At this time, the fastening cord 3 made of the flat rubber is disposed in a state of being rolled in the first latching hole 22, and the width dimension R1 thereof being larger than the inner peripheral length L1, a portion thereof is elastically deformed and enters into the straight part 21*b*. In a case in which the width dimension R1 of the fastening cord 3 is smaller than the inner peripheral length L1 of the first latching hole 22, in the worn state, the fastening cord 3, in spite of being disposed in the state of being rolled, may move in a frontward-rearward direction (a direction orthogonal to a paper surface). However, the width dimension R1 of the fastening cord 3 being larger than the inner peripheral length L1 and a portion thereof being entered into the straight part 21*b*, the movement of the fastening cord 3 is regulated.

Referring to FIGS. 6(C), (D), in a case in which a cord elastic member such as a strand-like cord rubber is used as the fastening cord 3, the inner peripheral length L1 of the first latching hole 22 is smaller than an outer peripheral dimension (outer peripheral length) R2 of the a circular cross-section of the fastening cord 3. Therefore, in a state in which the fastening cord 3 is disposed in the first latching hole 22 for wearing the mask 1, since a portion of the fastening cord 3 is elastically deformed and enters into the straight part 21*b*, the movement of the fastening cord 3 in the frontward-rearward direction is regulated similarly as the illustrative example in FIG. 6(A). In such manner, in a case in which the fastening cords 3, 4 are formed of a belt elastic member such as a flat rubber, and in a case in which the fastening cords 3, 4 are formed of a cord elastic member such as a rubber string, the width dimension R1 of the belt elastic member and the outer peripheral dimension R2 of the cord elastic member being larger than the inner peripheral length L1 of the first and second latching holes 22, 32, the movement of the fastening cords 3, 4 is regulated when the mask 1 is worn, and it is possible to suppress the offsetting of the fastening cords 3, 4. Moreover, in a case in which the upper portions 3A, 4A and lower portions 3B, 4B of the fastening cords 3, 4 have the same tension in the worn state, while the upper portions 3A, 4A may be pressed relatively strongly against the ear, thereby causing irritation, by the fastening cords 3, 4 being deformed elastically and causing an appropriate resistance, it is possible not to let the upper portions 3A, 4A and the lower portions 3B, 4B have the same tension, or in other words, to let the tension of the upper portions 3A, 4A to be smaller than the tension of the lower portions 3B, 4B.

In a case of putting the fastening cords 3, 4 around the ear upon folding over vertically as in the mask 1 according to the present embodiment, usually, the mask 1 is to be worn upon adjusting the length of the upper portions 3A, 4A and the lower portions 3B, 4B to match the dimension of head, before wearing the mask 1. In other words, in a case in which the length dimension of the upper portions 3A, 4A is relatively short, when the upper portions 3A, 4A are pulled up and hooked on the ear, since the upper portions 3A, 4A may be rubbed and the wearer may feel pain, the mask 1 is to be worn upon adjusting in advance the upper portions 3A, 4A to be relatively longer than the lower portions 3B, 4B. Moreover, as it has already been mentioned, the ear may feel pain when the tension of the upper portions 3A, 4A being the same as the tension of the lower portions 3B, 4B, even when the mask 1 is worn upon adjusting the tension of the upper portions 3A, 4A to be smaller, the tension of the upper portions 3A, 4A and the tension of the lower portions 3B, 4B may be of the same magnitude while the mask 1 is worn.

In the mask 1 according to the present embodiment, even in a case in which the fastening cords 3, 4 are formed of either a belt elastic member or a cord elastic member, since a portion thereof is elastically deformed and enters into the narrow width portion when latched in the first and second latching holes 22, 32, once latched, the fastening cords 3, 4 do not move in the frontward-rearward direction inadvertently. Consequently, it is possible to suppress the length dimension of the fastening cords 3, 4 adjusted in advance, from being changed while the mask 1 is worn. However, in a case in which the movement of the fastening cords 3, 4 is regulated thoroughly, the wearer cannot do the fine adjustment of the length dimension of the upper portions 3A, 4A and the lower portions 3B, 4B after wearing the mask 1. Therefore, it is preferable that the fastening cords 3, 4 are latched in a loose state to be able to move by pulling the fastening cords 3, 4 upward or downward with the required force. For realizing such latching, in the case in which the fastening cords 3, 4 are formed of a belt elastic member and in the case in which the fastening cords 3, 4 are formed of a cord elastic member, it is preferable that the width dimension R1 of the belt elastic member and the outer peripheral dimension R2 of the cord elastic member are 150% of the inner peripheral length L1 of the first and second latching holes 22, 32. In such manner, according to the latch 10 of the present embodiment, since the movement of the fastening cords 3, 4 in the frontward-rearward direction is regulated by the required resistance being applied to the fastening cords 3, 4, the tension adjusted of the upper and lower portions 3A, 3B, and 4A, 4B does not change by the movement of the mouth at the time of talking. Moreover, the wearer being able to adjust easily the length of the upper and lower portions 3A, 3B and 4A, 4B freely by operating by own hands, even when the tension thereof changes while being worn, it is possible to return to the appropriate tension.

Referring again to FIG. 2, a width dimension W4 of a portion positioned near the insertion through hole 31 of the cut 33 of the second latching part 30 is smaller than the width dimension W2 of the neck part 34, and is smaller than the width dimension W1 of the straight part 21*b* of the guide channel 21. Moreover, while the width dimension W1 of the straight part 21*b* and the width dimension W2 of the neck part 34 are of the magnitude that allows the fastening cords 3, 4 made of a belt elastic member or a cord elastic member to be passed toward the first latching hole 22 while being deformed elastically, it is preferable that the width dimension W4 of the cut 33 is of a magnitude that does not allow the fastening cords 3, 4 to pass even when deformed elastically. The fastening cords 3, 4 being inserted into the insertion through hole 31 in advance, by making the width dimension W4 of the cut 33 relatively small in such manner, it is possible to prevent the fastening cord 3 from coming off the latch 10. On the other hand, in the first latching part 20, although the guide channel 21 has a size that allows the fastening cord 4 to pass through, being curved substantially toward the second latching hole 32 compared to the cut 33, even when the latching in the latching hole 22 is released and the fastening cord 4 moves toward the first lateral edge 11 side, the fastening cord 4 is not susceptible to come off the latch 10 easily.

Second Embodiment

Figure 7:
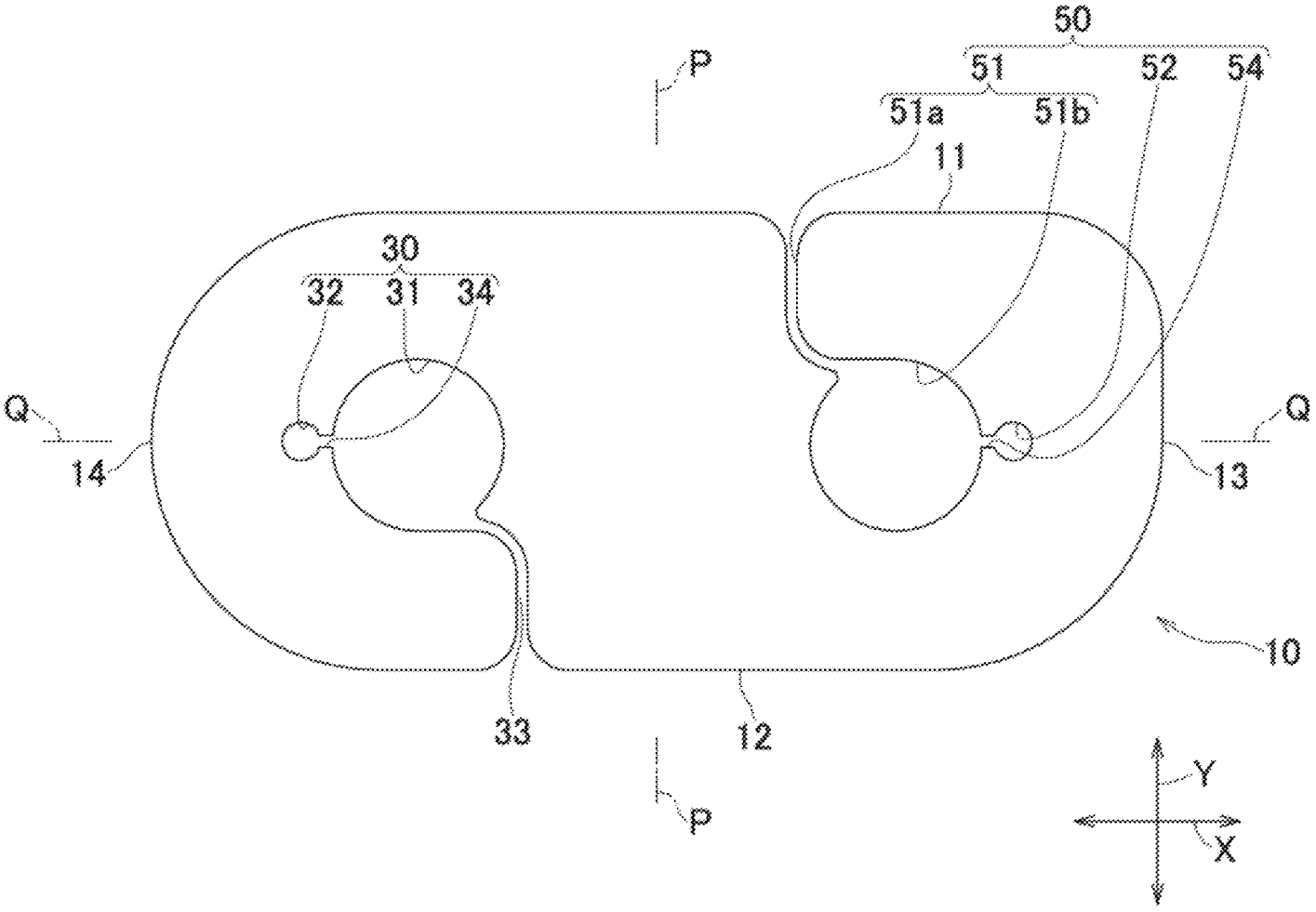
FIG. 7 is a plan view of a latch in a second embodiment.

FIG. 7 is a plan view of the latch 10 in the mask 1 provided with the latch 10 according to a second embodiment. The latch 10 according to the present embodiment has basically an arrangement same as that of the latch 10 according to the first embodiment, and points that differ from the first embodiment will be described below.

Referring to FIG. 7, in the latch 10 according to the present embodiment, a first latching part 50 has a shape same as that of the second latching part 30, and a guide channel 51 of the first latching part 50 has a first portion 51*a* extending inward from the first lateral edge 11, and a second portion 51*b* having same shape and same size as that of the insertion through hole 31 of the second latching part 30, communicating with the first portion 51*a*. The first portion 51*a* is slightly curved toward the first end edge 13 side at the second portion 51*b* side. The second portion 51*b* communicates with the first latching hole 52 via a neck part 54 on the first end edge 13 side. In the latch 10 having such shape, the fastening cord 3 may have been inserted into the second latching part 30 in advance, and the fastening cord 4 may have been inserted into the second portion 51*b* of the first latching part 50 in advance. Moreover, at the time of wearing, the fastening cord 4 may be passed through with the first portion 51*a* of the first latching part 50 as a guide.

The latch 10 of the mask 1 according to the present invention, apart from being formed of a soft or hard synthetic resin, may be made of a paper or a metal, in so far as the latch 10 exerts the required elasticity. Moreover, regarding an outer shape thereof, a corner part may be sharp pointed and not curved, in so far as the first latching parts 20, 50 and the second latching part 30 are positioned side-by-side in the lateral direction X, and it is possible to adjust appropriately a dimension and a thickness dimension in the vertical direction Y and the lateral direction X in accordance with the size of the mask 1 to be used. Furthermore, in order to grant a design to the latch 10, the latch 10 may be colored with chromatic color, or various design elements such as a picture, a symbol, an alphabet, a product logo may have been disposed.

The disclosure related to the present invention described heretofore can be summed up as follows.

The mask provided with latch which is in the form of an oblong thin sheet, having the vertical direction and the lateral direction, and including the first and second lateral edges extending in the lateral direction, and the first and second end edges extending in the vertical direction, includes the first latching part for disengageably latching one fastening cord of the mask, and the second latching part positioned on the second end edge side of the first latching part, and having the insertion through hole for inserting the other fastening cord of the mask in advance, wherein the first latching part has the guide channel extending from the first lateral edge, and the first latching hole connected to the guide channel, and the second latching part has the second latching hole communicating with the insertion through hole, and having an outer shape smaller than that, and the first latching hole and the second latching hole are directed in directions opposed to one another in the lateral direction.

The present invention can include at least the following embodiments. The embodiments can be adopted upon isolating or combining with one another.

(1) The guide channel of the first latching part has a first part extending inward from the first lateral edge, and a second part having a circular shape larger than an outer shape of the first latching hole, communicating with the first latching hole.

(2) The fastening cord is formed of a belt elastic member, and the width dimension of the fastening cord is larger than the inner peripheral length of the first and the second latching holes.

(3) The fastening cord is formed of a cord elastic member, and the outer peripheral dimension of the fastening cord is larger than the inner peripheral length of the first and second latching holes.

(4) The second latching part has the cut connected to the insertion through hole, and the width dimension of the portion positioned near the insertion through hole of the cut is smaller than the width dimension of the neck part.

(5) The mask provided with latch includes the mask body having a cup-shaped covering part.

(6) The mask body has the face-contact part positioned on a rear surface side of the outer peripheral edge of the covering part.

The invention claimed is:

1. A mask, comprising:

a latch in the form of an oblong thin sheet, having a vertical direction and a lateral direction, and including a first and second lateral edges extending in the lateral direction and a first and second end edges extending in the vertical direction, and first and second fastening cords, wherein the latch includes a first latching part for disengageably latching the first fastening cord of the mask; and a second latching part positioned between the second end edge and the first latching part, and having an insertion through hole for inserting the second fastening cord of the mask in advance, the first latching part has a guide channel extending from the first lateral edge, and a first latching hole connected to the guide channel, the second latching part has a second latching hole separated from and communicating with the insertion through hole, and the second latching hole having a diameter smaller than a diameter of the insertion through hole, and the first latching hole and the second latching hole are directed in directions opposed to one another in the lateral direction.

2. The mask according to claim 1, further comprising: a mask body having a cup-shaped covering part.

3. The mask according to claim 2, wherein the mask body has a face-contact part positioned on a rear surface side of an outer peripheral edge of the covering part.

4. The mask according to claim 1, wherein the guide channel of the first latching part has a first portion extending inward from the first lateral edge, and a second portion having a diameter larger than a diameter of the first latching hole, and communicating with the first latching hole.

5. The mask according to claim 1, wherein each of the first and second fastening cords is a belt elastic member, and a width dimension of each of the first and second fastening cord is larger than an inner peripheral length of the first latching hole and an inner peripheral length of the second latching hole.

6. The mask according to claim 1, wherein each of the first and second fastening cords is formed of a cord elastic member, and an outer peripheral dimension of each of the first and second fastening cords is larger than an inner peripheral length of the first latching hole and an inner peripheral length of the second latching hole.

7. The mask according to claim 1, wherein the second latching part has a cut connected to the insertion through hole and including a portion positioned near the insertion through hole, the insertion through hole and the second latching hole are separated from each other by a neck part of the second latching part, and a width dimension of the portion positioned near the insertion through hole is smaller than a width dimension of the neck part.

* * * * *